United States Patent [19]

Vick et al.

[11] Patent Number: 4,844,103

[45] Date of Patent: Jul. 4, 1989

[54] BENDABLE PERMANENT WAVE ROD APPARATUS

[76] Inventors: Eddie E. Vick, 3200 Iris, Pine Bluff, Ark. 71603; Hazel H. Cummings, 5507 W. Flipper, Pine Bluff, Ark. 71602

[21] Appl. No.: 133,007

[22] Filed: Dec. 15, 1987

Related U.S. Application Data

[63] Continuation-in-part of Ser. No. 102,916, Sep. 30, 1987, abandoned, which is a continuation-in-part of Ser. No. 798,108, Jul. 25, 1986, abandoned.

[51] Int. Cl.[4] ..... A45D 2/14

[52] U.S. Cl. ..... 132/245; 132/246; 132/248

[58] Field of Search ..... 132/42 R, 40, 33 R, 132/43 R, 43 A, 44, 245, 246, 248, 250, 251, 253, 254

[56] References Cited

U.S. PATENT DOCUMENTS

| | | | |
|---|---|---|---|
| 850,553 | 4/1907 | West | 132/42 R |
| 1,619,743 | 3/1927 | McClaire | 132/43 R |
| 1,917,341 | 7/1933 | Thau | 132/43 A |
| 2,112,074 | 3/1938 | Cunnyngham | 132/42 R |
| 2,396,782 | 3/1946 | Grant | 132/42 R |
| 2,537,728 | 1/1951 | Wright | 132/248 |
| 2,563,421 | 8/1951 | Roth | 132/42 R |
| 2,757,676 | 8/1956 | Hamilton | 132/42 R |
| 2,787,276 | 4/1957 | Loucks | 132/42 R |
| 2,838,053 | 6/1958 | Zimmerman | 132/42 R |
| 2,838,054 | 6/1958 | Fischer | 132/43 R |
| 2,853,080 | 9/1958 | Brancaccio | 132/42 R |
| 2,953,140 | 9/1960 | Goff | 132/250 |
| 3,530,863 | 9/1970 | Foster | 132/40 |
| 3,712,310 | 1/1973 | Parlagreco | 132/40 |
| 3,960,157 | 6/1976 | Andrews et al. | 132/40 |
| 4,236,540 | 12/1980 | Takagi et al. | 132/33 R |
| 4,540,006 | 9/1985 | Collis | 132/246 |
| 4,572,221 | 2/1986 | Barradas | 132/246 |

*Primary Examiner*—Gene Mancene
*Assistant Examiner*—Adriene J. Lepiane
*Attorney, Agent, or Firm*—William E. Noonan

[57] ABSTRACT

A bendable permanent wave rod is disclosed including an elongate rod that includes a core portion composed of a material that is longitudinally bendable into a selected shape and self-sustainable in that shape, and a flexible, substantially non-absorbent outer portion bonded to and sealably covering the core portion. The outer portion has an exterior surface that includes a coefficient of friction such that hair that engages the exterior surface resists slipping relative thereto. An elongate flexible hair retaining band having first and second end portions is provided. The first end portion is attached to first end of the rod and the second end portion is selectively secured to the opposite second end of the rod to secure the rod onto the hair rolled onto the rod.

11 Claims, 2 Drawing Sheets

BENDABLE PERMANENT WAVE ROD APPARATUS

RELATED APPLICATIONS

This application is a continuation-in-part of application Ser. No. 102,916 filed Sept. 30, 1987 and abandoned Sept. 24, 1988, which application is a continuation-in-part of application Ser. No. 798,108 filed July 25, 1986 and abandoned Apr. 26, 1988.

FIELD OF THE INVENTION

This invention relates to a bendable hair roller or rod apparatus for use, particularly, in forming permanent waves and other hair styling operations.

BACKGROUND OF THE INVENTION

Conventional hair rollers have long been used for hair styling applications such as the formation of permanent waves. Such devices typically include a relatively straight, rigid rod upon which the hair is rolled and an elastic cord that secures the hair to the roller.

One of the problems exhibited by the relatively straight, rigid rollers in permanent wave applications is that they typically fail to provide the hair with a consistent curl all the way down to the scalp, particularly toward the ends of the roller rod. Rather, when the hair rolling is complete and the roller encounters the scalp, a relatively straight uncurled segment of hair, typically 3/16"–¾" in length is left extending between the scalp and the roller. Additionally, the elastic cord can exert undue crimping and cutting pressure upon, and cause damage to, the hair. Moreover, conventional hair rollers are often composed of a hard plastic material which may slip relative to the hair and add time and difficulty to the rolling operation.

Several bendable hair rollers that employ a bendable metallic core and an outer flexible layer are known. However, each possesses features that prevents its use in permanent wave operations. For example, some are not adequately sealed. One of these devices has holes in its outer layer and another employs an outer layer composed of absorbent foam. Permanent wave chemicals applied to these rollers could attack the metallic core and, particularly, soak into the body material and destroy the material. Additionally it would be impossible to remove the chemicals by washing, or other means, so that the roller could be put to further use in permanent wave applications. Moreover, none of the prior bendable hair rollers employs a strap to secure the hair to the roller. Instead, the roller itself or extended metal parts of the roller are bent around to hold the hair in place. These devices likewise do not permit a consistent curl to be formed all the way to the scalp.

SUMMARY OF THE INVENTION

It is therefore an object of the invention to provide a bendable permanent wave rod that may be contoured to the scalp and upper neck areas while remaining securely and safely attached to the hair to permit improved curling of the hair close to curved areas of the scalp and upper neck along the entire length of the roller rod.

It is a further object of this invention to provide a bendable permanent wave rod that may be versatily employed in forming permanent waves utilizing a variety of unusual wave patterns, and in various other hair styling operations.

It is a further object of this invention to provide a bendable permanent wave rod that is substantially non-absorbent and which does not damage or break the hair.

It is a further object of this invention to provide a bendable permanent wave rod that may be rolled quickly and conventionally on the hair with a reduced amount of slipping.

This invention relates from a realization that improved consistent curling of the hair closer to the scalp, and regardless of the hair's position along the length of the rod, may be achieved by employing a bendable permanent wave rod that may be bent so that it generally conforms to the contour of the scalp. This invention results from a further realization that such a rod is most securely held in place on the hair in its bent condition by an elongate strap that is attached to one end of the rod and selectively attached to the other end.

This invention features a bendable permanent wave rod apparatus that includes an elongate rod having a core portion composed of a material that is longitudinally bendable into a selected shape and self-sustainable in that shape. A flexible, substantially non-absorbent outer portion is bonded to and sealably covers the core portion. The outer portion has an exterior surface that includes coefficient of friction such that the hair that engages the exterior surface resists slipping relative thereto. An elongate flexible hair retaining band having first and second end portions is also provided. There are means for attaching the first end portion of the hair retaining band to the first end of the rod and means for selectively securing the second end portion of the hair retaining band to the opposite end of the rod to secure the rod onto hair rolled onto the rod.

In a preferred embodiment, a first hole is disposed in the first end portion of the band and the means for attaching include button means connected to the first end of the rod for engaging the first hole to attach the first end portion of the band to the first end of the rod. The means for selectively securing may include insertion means attached to the second end portion of the band and receptacle means connected to the second end of the rod for selectively receiving the insertion means to secure the second end portion of the band to second end of the rod. At least one hole may be disposed in the second portion and the means for selectively securing may include connector means that carry the insertion means and are selectively engageable with each hole in the second end portion to connect the insertion means to the second end portion. The band preferably includes a resilient, generally flat member. The first end portion may have a reinforced thickness and the second end portion may be laterally enlarged. Preferably, the band includes at least one intermediate hole disposed between the first end portion and the point at which the insertion means is connected to the second end portion. The button means may be selectively engageable with the intermediate hole to attach the band, at a location intermediate the first end portion and the point at which the insertion means is connected to the second end portion, to the first end of the rod. The core portion may include a bendable metal element.

DISCLOSURE OF PREFERRED EMBODIMENT

Other objects, features and advantages will occur from the following description of a preferred embodiment and the accompanying drawings in which.

Figure 1:
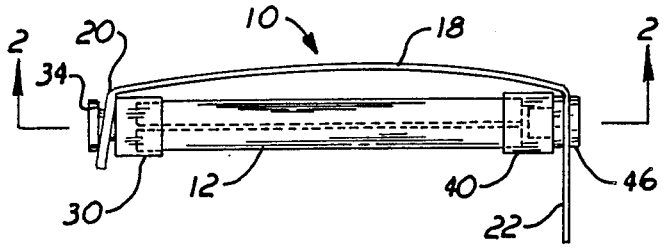
FIG. 1 is an elevational view of a bendable hair roller according to this invention.
Figure 2:
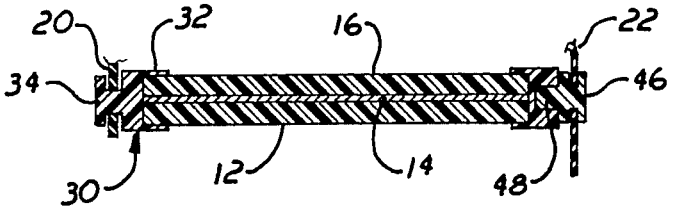
FIG. 2 is a sectional view taken along line 2—2 of FIG. 1.

There is shown in FIG. 1 a bendable permanent wave rod apparatus 10 including an elongate, generally cylindrical rod 12. As shown in FIG. 2, rod 12 includes an elongate core portion 14 that is composed of a material such as copper, aluminum or other soft metal that is longitudinally bendable into a selected shape. A particularly preferred metal is No. 12 copper wire although various other sizes of wire and/or metal or nonmetallic materials may be utilized. Core portion 14 must be self-sustainable in the selected shape until manually bent into an alternative shape. In other words, core portion 14 is flexible, but relatively nonresilient.

A flexible, substantially non-absorbing outer portion 16 is bonded to core portion 14. More particularly, core portion 14 is covered with surlyn or an alternative bonding agent by an extrusion process or other acceptable technique. Outer portion 16 is then formed and bonded onto core portion 14, such as by an appropriate extrusion process. The outer portion is typically composed of an elastomeric synthetic resin material such as Santoprene TM, although various other elastomers such as rubber may be utilized. A thin non-porous outer layer of the same or similar material forms the exterior surface of outer portion 16. This material used should have a coefficient of friction such that the exterior surface of outer portion 16 engages hair being rolled on rod 12 without slipping relative to the hair.

Figure 3:
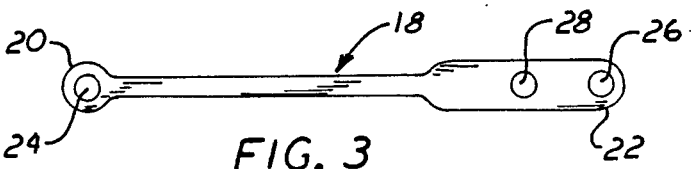
FIG. 3 is an elevational view of the hair retaining band.

An elongate flexible hair retaining band 18, shown alone in FIG. 3, is attached to rod 12. Band 18 is preferably composed of a resilient material such as Santoprene TM although alternative synthetic resins or rubber may also be employed. By comparing FIGS. 1 and 3 it can be seen that the band 18 is generally flat, e.g. its width is substantially greater than its thickness. As explained below, this permits the band to engage the rolled hair without undue pressure, thereby reducing damage to the hair. Band 18 includes a first end portion 20 which, as shown in FIG. 1, preferably has a reinforced thickness. Band 18 includes, at its opposite end, a second end portion 22 that, as best shown in FIG. 3, is laterally enlarged relative to the remainder of band 18. First end portion 20 includes a first hole 24 disposed therethrough. A second hole 26 is disposed through second portion 22 of band 18 and an intermediate hole 28 is also disposed through second end portion 22 at a point located longitudinally between first and second holes 24 and 26.

Figure 4:
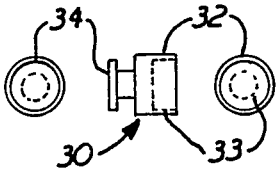
FIG. 4 is a side view and respective end views of the end piece mounted at the first end of the rod.

As shown in FIGS. 1–3, means are provided for attaching first end portion 20 of band 18 to a first end of the rod. As illustrated more clearly in FIG. 2 such means may include an end piece 30, shown alone in FIG. 4, having a base portion 32. A central recess 33 formed in base 32 receives a first end of rod 12. Adhesive or other suitable means are employed to fix or bond end piece 30 to the end of rod 12. A button portion 34 extends from and is preferably integrally connected to base portion 32. End portion 20 of band 18 is fastened to end piece 30 by stretching the resilient material of band 18 to expand first hole 24 and inserting button portion 34 through the enlarged hole 24 so that end portion 20 is secured to end piece 30 in the manner shown in FIG. 1. After button portion 34 is inserted through the enlarged hole 24 the first end portion 20 is permitted to resiliently return to its unstretched condition so that hole 24 returns to its original size. Because this size is smaller than the head of button portion 34, first end portion 20 of band 18 remains attached to end piece 30 and therefore to the end of rod 12.

Figure 7:
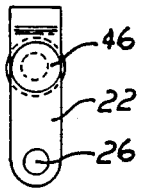
FIG. 7 is an elevational end view of the second end of the bendable hair roller.
Figure 5:
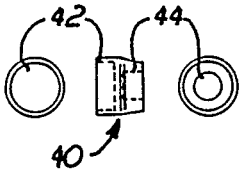
FIG. 5 is a side view and respective end views of the end piece attached at the second end of the rod.
Figure 6:
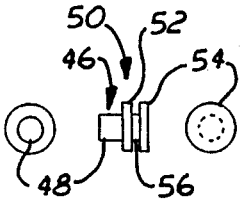
FIG. 6 is a side view and respective end views of the plug which is attached to the second end portion of the hair retaining band and includes an insertion member that is selectively receivable in the receptacle of the end piece of FIG. 5.

The opposite second end portion 22 of band 18 is selectively attached to the opposite second end of rod 12 by means that include an end piece 40, shown in FIGS. 1 and 2 and alone in FIG. 5. End piece 40 also includes a generally cylindrical central recess 42 that receives the second end of rod 12. Similar to end piece 30, end piece 40 is glued or otherwise permanently bonded to the second end of rod 12. As best shown in FIGS. 2 and 5, end piece 40 includes a central receptacle 44 that faces outwardly from the end of rod 12. Recess 44 has a diameter which permits it to snugly receive a plug 46 that is attached to second end portion 22 of band 18 as shown in FIGS. 1 and 2. Plug 46, shown alone in FIG. 6, includes an insertion means comprising a generally cylindrical member 48, and connector means 50 comprising a pair of buttons 52 and 54 as well as a post 56 that interconnects buttons 52 and 54. As shown in FIGS. 1, 2, and 7, insertion member 48 is attached to second end portion 22 of band 18 by connector means 50 of plug 46. More particularly, to effect this attachment intermediate hole 28 is expanded by stretching the resilient second portion 22 and button 54 is inserted through the expanded hole 28. The hole is then permitted to return to its original shape so that post 56 extends through hole 28 and second portion 22 is secured between buttons 52 and 54. Second portion 22 is selectively secured to the second end of rod 12 by introducing insertion member 48 into central receptable 44 in end piece 40. This secures the roller 10 onto hair rolled onto the rod 12 in the manner shown in FIG. 8.

Although insertion member 48 and receptacle 44 are disclosed as generally cylindrical shapes, in alternative embodiments these elements may have other complementary non-cylindrical shapes. Additionally, in alternative embodiments, second end portion 22 may be attached closer to its distal end to plug 46 by engaging connector means 50 of plug 46 in precisely the above manner with second hole 26 in second portion 22. By adjusting the location at which the plug 46 is attached to second portion 22, in this manner, band 18 may be effectively lengthened or shortened to accommodate different quantities of hair.

Figure 8:
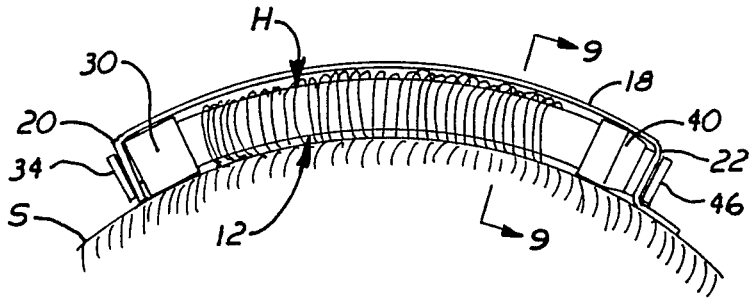
FIG. 8 is an elevational side view of the bendable hair roller rolled onto a person's head and generally conforming to the contour of the scalp.
Figure 9:
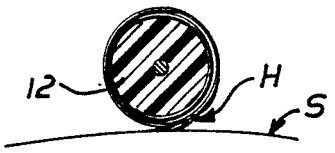
FIG. 9 is a sectional view taken along line 9—9 of FIG. 8.

Apparatus 10 may be employed for curling hair in the manner shown in FIG. 8. Initially, plug 46 is removed from second end piece 40. With roller 10 in the substantially straight, cylindrical condition shown in FIG. 1, hair is rolled in a conventional manner onto rod 12. As rod 12 approaches the scalp it is bent upwardly in a slight arc that generally conforms to the contour of the head. Rod 12 is then rotated approximately another final one-half turn so that it generally conforms to the scalp S in the manner shown in FIG. 8. This seats rod 12 along its entire length directly over the roots of the hair H. As a result, all of the strands of hair H are rolled upon rod 12 in a uniform manner very close to the scalp S, such as shown in FIG. 9. Band 18 is then attached to end piece 40 by introducing insertion member 48 of plug 46 into receptacle 44 of end piece 40. As a result, the bent rod 12 remains securely attached to the rolled hair H for any desired amount of time while applied chemicals process the hair to remain in a curled condition with the rod removed. The rod apparatus 10 is eventually removed simply by removing plug 46 from end piece 40 and unrolling the hair from the rod. The hair H will then, without the rod attached, return to its curled condition and leave a tighter, more consistently curled permanent wave. Futhermore, because the band 18 is generally flat and resilient excess pressure is not applied to the hair rolled on the rod apparatus and damage to the hair is prevented.

Figure 10:
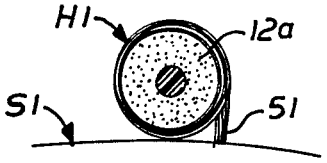
FIG. 10 (PRIOR ART)
FIG. 10 is a cross-sectional view of a conventional straight hair roller with a section of hair rolled thereon.

In contrast, when conventional, substantially rigid and straight rollers of the prior art are employed, as shown in FIG. 10, the strands of hair H1 that are rolled onto rod 12*a* toward the longitudinal ends of the rod typically cannot be curled close to the scalp. Rather, an uncurled section of hair 51 extends from scalp S1 to the straight rod 12*a*. As previously stated, this straight section of hair 51 may extend anywhere from three-sixteenths to three-quarters of an inch in length. Because section 51 is not curled in the manner of the remainder of the hair, an uneven and often unsatisfactory permanent wave is provided. Conversely, because rod 12 of this invention generally conforms to the contour of the scalp and the scalp is hugged, the hair is curled to an optimal degree along the entire length of rod 12. This results in what is referred to as "lift" or controlled "springiness" of the hair starting right at the scalp S. By employing a number of rod apparatus 10 over the entire head an improved permanent wave that is longer lasting and has greater volume is produced.

Figure 11:
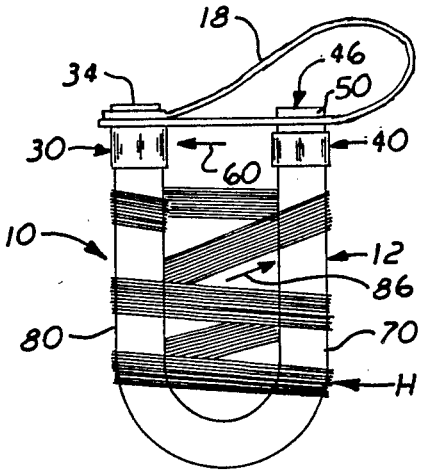
FIG. 11 is an elevational side view of the bendable hair roller being employed in an alternative hair styling operation.

Apparatus 10 may also be employed in a variety of alternative hair styling operations. For example, as shown in FIG. 11, rod 12 may be bent into a generally U-shaped configuration to perform unusual wave patterns in the hair. Initially, with rod 12 in its straightened condition, plug 46 is removed from end piece 40 and hair H is rolled one-half turn on the center of rod 12. The rod is then bent into the illustrated generally "U" shape. To secure band 18 tightly between first and second end pieces 30 and 40, connector means 50 of plug 46 is attached to band 18 through intermediate hole 28 in second end portion 22 and plug of 46 is inserted into end piece 40. The second end is then stretched longitudinally in the direction of arrow 60 so that portion 34 of end piece 30 may be engaged with distal second hole 26. As a result, band 18 is attached to the opposite ends of the rod at holes 26 and 28 and remains sufficiently tight to hold bent apparatus 10 in the "U" shape.

The hair waving operation is then completed by weaving hair H generally in a "figure 8" pattern along the rod. For example, hair H is first wound around right leg 70 and then around left leg 80 of rod 12. This weaving action is continued, as shown in FIG. 11, upwardly along both legs 70 and 80 of rod 12 in the direction of arrow 86.

Apparatus 10 of this invention may be provided and used in various sizes for addressing a wide variety of hair styling applications. For example, the rod 12 may come in lengths of 2, 3, 4, and 8 inches although these figures are representative only and are not limitations of the invention. Because rod 12 may be bent into various desired shapes, roller 10 may be employed effectively to treat a number of hair problems such as irregularities of the scalp, scars, plateau areas of the head, cowlicks and crown problems.

The rod and hair retaining band are composed of a typically rugged material and provide a long life over repeated uses in hair styling operations. Rollers 10 may be effectively employed for both commercial and home uses. Because the material employed in outer portion 12 is non-absorbent and because end pieces 30 and 40 are permanently bonded to the ends of rod 12, the preferably metal core is effectively sealed. As a result, permanent wave solutions applied to the rolled hair will not encounter or react with, and thereby damage, the metal core 14. Also the non-absorbency of the outer portion 16 prevents applied permanent wave solutions from soaking into portion 16 and therefore permits rod 12 to be used subsequently in later applications.

It will thus be seen that the objects made apparent from the preceding description are sufficiently obtained and certain changes may be made in the above construction without departing from the scope of the invention and it is intended that all matter contained in the above description and shown in the accompanying drawings may be interpreted as illustrative and not in a limitative sense. It is also understood that the following claims are intended to cover all the generic and specific features of the invention herein described and all statements of the scope of the invention which, as a matter of language, may be said to fall therebetween. Although specific features of the invention are shown in some drawings but not in others this is for convenience only as each feature may be combined with any or all of the features in accordance with the invention.

Other embodiments will occur to those skilled in the art and are within the following claims:

What is claimed is:

1. A bendable permanent wave rod apparatus comprising:

an elongate rod that includes a core portion composed of a material that is longitudinally bendable into a selected shape and self sustainable in that shape, and a flexible, substantially non-absorbent elastomeric outer portion bonded to and sealably covering said core portion and being substantially immovable relative to said core portion, said outer portion having an exterior surface that includes a coefficient of friction such that hair that engages said exterior surface resists slipping relative thereto;

an elongate, generally flat, flexible and resilient hair retaining band having first and second end portions;

means for attaching said first end portion of said hair retaining band to a first end of said rod; and means for selectively securing said second end portion of said hair retaining band to an opposite second end of said rod to secure said rod onto hair rolled onto said rod.

2. The apparatus of claim 1 in which said means for selectively securing includes insertion means connected to said second end portion of said band and receptacle means fixed to said second end of said rod for selectively receiving said insertion means to secure said second end portion of said band to said second end of said rod.

3. The apparatus of claim 1 in which said hair retaining band includes a first hole disposed in said first end portion and said means for attaching includes button means connected to said first end of said rod for engaging said first hole to attach said first end portion of said band to said first end of said rod.

4. The apparatus of claim 3 in which said means for selectively securing includes insertion means connected to said second end portion of said band and receptacle means fixed to said second end of said rod for selectively receiving said insertion means to receive said second end portion of said band to said second end of said rod.

5. The apparatus of claim 4 in which said band includes at least one intermediate hole disposed between said first end portion and the point at which said insertion means is connected to said second end portion, said button means being selectively engageable with said intermediate hole to attach said band, at a location intermediate said first end portion and the point at which said insertion means is connected to said second end portion, to said first end of said rod.

6. The apparatus of claim 4 in which said means for selectively securing include at least one hole disposed in said second end portion and connector means that carry said insertion means and are selectively engageable with each said hole in said second end portion to connect said insertion means to said second end portion.

7. The apparatus of claim 1 in which said band includes a first end portion having a reinforced thickness.

8. The apparatus of claim 1 in which said second end portion is laterally enlarged.

9. The apparatus of claim 1 in which said core portion is composed of a bendable metal element.

10. The apparatus of claim 1 in which said outer portion includes a relatively thin non-absorbent exterior surface.

11. A bendable permanent wave rod comprising:

an elongate, generally cylindrical rod that includes a metal core portion which is longitudinally bendable into a selected shape and self sustainable in that shape, and a flexible, substantially non-absorbent elastomeric outer portion bonded to and sealably covering said core portion and being substantially immovable relative to said core portion, said outer portion having an exterior surface that includes a coefficient of friction such that hair that engages said exterior surface resists slipping relative thereto;

an elongate generally flat, flexible and resilient hair retaining band having first and second end portions;

a first hole disposed in said first end portion of said band and button means fixed to a first end of said rod for engaging said first hole to attach said first end portion of said band to said first end of said rod; and insertion means attached to said second end portion of said band and receptacle means fixed to a second end of said rod for selectively receiving said insertion means to secure said second end portion of said band to said second end of said rod, whereby said rod is secured onto hair rolled onto said rod.

* * * * *